US005449563A

United States Patent [19]

Zhang

[11] Patent Number: 5,449,563

[45] Date of Patent: Sep. 12, 1995

[54] GALVANIC PROTECTION OF REBAR BY ZINC WIRE

[75] Inventor: Xiaoge G. Zhang, Toronto, Canada

[73] Assignee: Cominco Ltd., Vancouver, Canada

[21] Appl. No.: 246,456

[22] Filed: May 20, 1994

[51] Int. Cl.[6] ..... B32B 15/18

[52] U.S. Cl. ..... 428/592; 428/649; 428/653; 428/659; 428/933; 228/262.44; 52/786.13

[58] Field of Search ..... 428/649, 601, 659, 614, 428/933, 592, 653; 52/720, 414; 228/263.16, 262.44; 72/47; 164/98

[56] References Cited

U.S. PATENT DOCUMENTS

| | | | |
|---|---|---|---|
| 2,762,771 | 9/1956 | Preiser | 428/933 |
| 3,152,059 | 10/1964 | Wellington | 428/933 |
| 3,742,588 | 7/1973 | George | 228/262.44 |
| 3,834,149 | 9/1974 | Nisbet | 57/139 |
| 4,496,444 | 1/1985 | Bagnulo | 204/148 |
| 4,917,966 | 4/1990 | Wilde et al. | 428/659 |
| 5,066,548 | 11/1991 | Quantin et al. | 428/658 |
| 5,069,822 | 12/1991 | Callaghan et al. | 252/511 |

FOREIGN PATENT DOCUMENTS 2944878 7/1979 Germany .

*Primary Examiner*—John Zimmerman
*Attorney, Agent, or Firm*—Arne I. Fors; Doak Horne; Jeffrey T. Imai

[57] ABSTRACT

Reinforcing steel bar (rebar) in reinforced concrete is inhibited from corrosion by attaching a zinc wire, such as by welding, soldering or co-extrusion, along the length of the rebar. Zinc wire attached to the rebar provides galvanic protection to the steel to prevent iron corrosion and subsequent deterioration of the reinforced concrete.

16 Claims, 2 Drawing Sheets

GALVANIC PROTECTION OF REBAR BY ZINC WIRE

BACKGROUND OF THE INVENTION

This invention relates to galvanic protection of elongated steel articles by attaching a wire or strip of a sacrificial metal or metal alloy along the length thereof, and more particularly, relates to the galvanic protection of a reinforcing steel bar by providing a zinc wire attached to the length of the reinforcing steel bar and to the product produced thereby.

Corrosion and deterioration of reinforced concrete on bridge decks, support columns and parking structures is a problem of increasing significance in terms of cost of repair and safety. The permeable nature of concrete eventually allows water and sodium chloride from road salt to enter the concrete structure and chemically react with the reinforcing steel to cause corrosion. In the first stages of iron corrosion, de-adhesion occurs at the iron/concrete interface. As corrosion continues, the iron corrosion products expand causing delamination, cracking and significant weakening of the concrete structure.

In an attempt to inhibit rebar corrosion in reinforced concrete many methods and procedures have been proposed. German Patent No. 2,944,878 discloses a method whereby reinforcing steel bars (rebars) are tightly enclosed by a metal or plastic protective sheath. The impervious sheath of metal, synthetic resin or the like material prevents intimate contact of the rebar with water and corrosive salts, thus reducing the rate of corrosion of the rebar. In practice, especially with large diameter rebar, the placement of the rebar and the pouring of concrete often results in a nick or scrape of the protective coating of the rebar allowing the corrosive salts to react with the bare iron which consequently corrodes.

Preventing the ingress of water and salts into a concrete structure where they may react with the rebar has been attempted by means of an impermeable mastic coating applied to the concrete surface. Mastic coatings are generally not very durable and must be protected from vehicular traffic with a tough overlay material. Constant monitoring is also required to ensure a water-tight surface is provided.

U.S. Pat. No. 5,069,822 discloses a method to protect rebar from corrosion by using an impermeable membrane in combination with a cathodic protection system. The membrane material is made of chloroprene or polyurethane and can be overcoated by a wear layer.

Cathodic protection used in combination with the membrane above is known and similar to that of U.S. Pat. No. 4,496,444. A sacrificial anode in the form of a small block is in electroconductive communication with a surface such as iron to be protected. The sacrificial anode made of a material such as zinc has a greater potential to react chemically with salts or the like, thus corroding sacrificially while protecting the iron rebar.

The use of zinc for protection of rebar is also known in the form of galvanized rebar. In galvanizing, a thin continuous coating of zinc is provided on the complete steel surface, providing not only barrier protection but also galvanic protection to the rebar. It has been found that zinc may corrode inside concrete at a rate depending on ambient conditions. In regular hot-dipped galvanized rebar, the coating of zinc enveloping rebar is typically about 100 μm in thickness. The corrosion of rebar steel will occur when this zinc coating is consumed.

SUMMARY OF THE INVENTION

It is a principal object of the present invention to provide a method of providing galvanic protection to a steel article by attaching a wire or strip of a sacrificial metal along the length of the steel article.

It is another object of the present invention to provide a reinforcing steel bar for use in concrete employing a novel sacrificial anode for optimum galvanic protection of the steel bar.

A further object of the present invention is to provide a corrosion-resistant rebar which is easy to manufacture and install.

In accordance with the present invention, the corrosion of rebars in concrete structures is drastically reduced, improving the expected life and safety of concrete structures.

In its broad aspect, the present invention relates to a method of providing galvanic protection to a steel article comprising attaching at least one wire or strip of a sacrificial metal or metal alloy selected from the group consisting of zinc, aluminum and magnesium and their alloys in continuous electrical contact along the length of the steel article. The sacrificial metal may be attached to the steel article by welding, soldering or co-extrusion.

The product of the invention is a galvanically-protected steel article comprising a steel article with at least one wire or strip of a sacrificial metal or metal alloy selected from the group consisting of zinc, aluminum and magnesium and alloys thereof attached in continuous electrical contact along the length of the steel article. The steel article may be a steel beam, bar, rod, strip, pipe, plate or channel. A single straight zinc wire or strip or a plurality of parallel spaced-apart zinc wires or zinc strips can be secured to the steel article along the length thereof.

Most typically, the rebar of the invention is for use in reinforced concrete and comprises a steel bar having a zinc strip secured in electrical contact along the length of the steel bar by welding or soldering or fabricated into the rebar by co-extrusion.

BRIEF DESCRIPTION OF THE DRAWINGS

The preferred embodiments of the present invention will now be more fully described with reference to the accompanying drawings, in which.

DESCRIPTION OF THE PREFERRED EMBODIMENT

Figure 1:
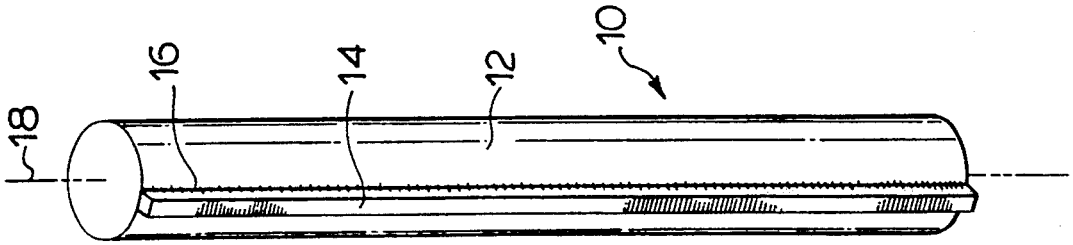
FIG. 1 is a perspective view of a preferred embodiment of the invention showing a zinc wire attached to reinforcing steel member along the length thereof.

Referring now to FIG. 1 a preferred embodiment of the present invention is shown. Although the description will proceed with reference to a rebar having a zinc wire attached thereto along its length parallel or helical to the longitudinal axis of the bar, it will be understood that the product of the invention will include steel articles such as a bar, rod, beam, strip, pipe, plate, channel and the like steel members having at least one wire or strip of a sacrificial metal or metal alloy such a zinc, aluminum or magnesium or their metal alloys attached thereto along the length thereof. The wire or strip may be attached by welding, soldering or co-extruding the wire or strip to the article in continuous electrical contact along the length of the strip. Large articles may have two or more wires or strips attached thereto, preferably equispaced on the surface of the article. Although a zinc wire of rectangular cross-section is illustrated and described herein, the wire can have a circular, semi-circular, elliptical or the like cross-section.

The rebar 10 illustrated comprises a steel bar 12 having a generally cylindrical cross section with a length determined by manufacturing or transportation limitations. A straight zinc wire 14 is secured electroconductively such as by a continuous weld 16 onto the surface of the bar parallel to the longitudinal axis 16 of the bar along the length of the bar.

Figure 2:
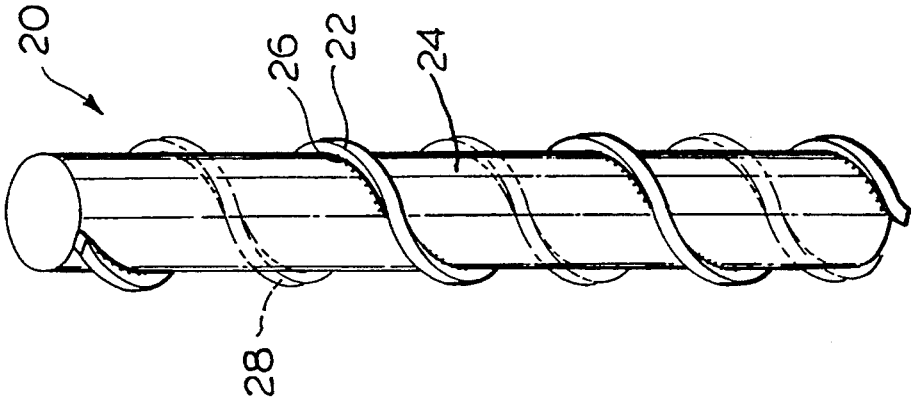
FIG. 2 is a perspective view of another embodiment of the invention showing a zinc wire attached to a reinforcing steel member along the length thereof in a helical path.

The rebar 20 illustrated in FIG. 2 has a zinc wire 22 secured to steel bar 24 such as by a continuous weld 26 in a helical path. A second zinc wire 28, shown by ghost lines, may also be secured to bar 24 substantially parallel to wire 22 by a weld.

The zinc wire acts as a sacrificial anode when the rebar is exposed to corrosive substances such as water and road salts which permeate reinforced concrete structures such as bridge decks in which the rebar is embedded. The amount of zinc corrosion is proportional to the surface area of the zinc. A zinc wire will last much longer than a zinc coating because for the same volume of zinc the wire has a much smaller surface area than the coating. For example, if a steel rebar of 10 mm in diameter has a continuous coating of 0.1 mm thick, the amount of zinc coating on the rebar is equivalent to that of a zinc wire 2 mm in diameter. At similar rates of corrosion, the substantially thicker wire would last many times longer than the thin coating. A substantially semi-circular zinc strip secured to a rebar would optimize the volume to surface area ratio to provide maximum life and sacrificial protection to the rebar.

Securement of said zinc to the rebar may take any form provided electrical contact is achieved. A zinc strip or wire may be soldered or welded to the rebar or a zinc welding rod may be axially deposited on the rebar. During the manufacture of the rebar, zinc may be co-extruded with the steel.

The invention and operating parameters will now be described with reference to the following non-limitative example.

Figure 3:
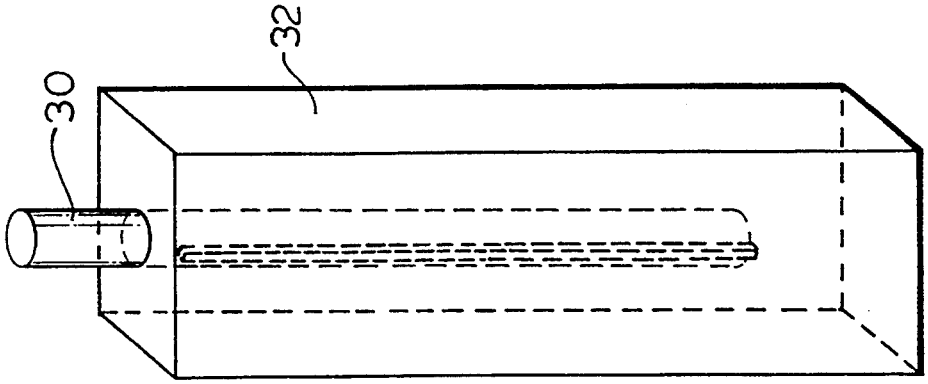
FIG. 3 is a perspective view showing schematically a concrete slab in which rebars were embedded for cyclic wet and dry tests.
Figure 4:
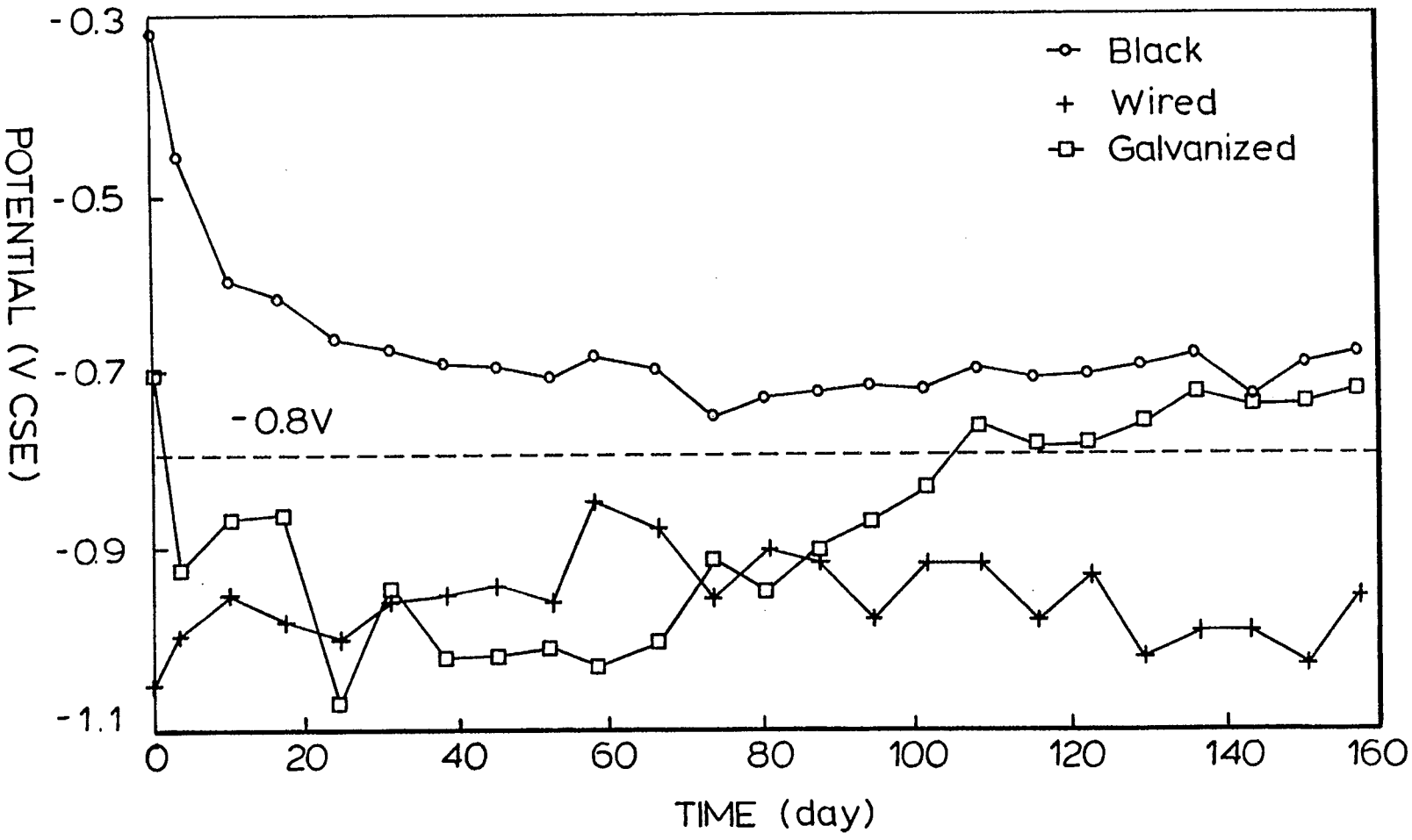
FIG. 4 is a graph illustrating the electrode potential of various rebar configurations inside concrete during a cyclic wet and dry tests with respect to a saturated copper sulphate reference electrode.

A half-year comparative experimental program was carried out to test the feasibility of this concept. In the experiments, different kinds of rebars were evaluated, namely black rebar, galvanized rebar, and wired rebar produced according to the present invention. The galvanized rebar had an average coating thickness of about 0.11 mm. The wired rebar according to the invention comprised a steel bar 30 having a 11 mm diameter with a rectangular zinc wire 32 having a 1.6 mm by 2 mm cross-section dimension continuously welded to the steel bar substantially along the length of the steel bar as shown in FIG. 3. The rebars were cast into concrete slabs 34 about 15 cm long of different cross-section dimensions of 3 cm×3 cm, 5 cm×5 cm or 8 cm×8 cm, as illustrated in FIG. 3, since the overlay thickness of concrete is very important in determining the rate of corrosion of rebar inside concrete. The concrete slabs with rebars were subjected to a weekly cyclic immersion and drying test in which the concrete slabs were immersed in a 3.5% by weight NaCl solution at 40° C. for four days and the concrete slabs were then dried in an oven at about 60° C. for three days. At the end of each immersion period the electrode potential of the rebars in the wet concrete was measured using a saturated copper sulphate reference electrode. The results of electrode potential measurements are shown in FIG. 4. All the slabs were broken at the end of the half year test and the surface condition of the rebars was visually evaluated for the extent of red rust.

Visual inspection showed that all the wired rebar samples of three different concrete overlay thicknesses had little red rust while the surface of black rebar samples were fully covered with red rust. The galvanized rebar samples were found to be covered with red rust and most of the zinc coating was corroded. This test indicated that the zinc wire attached to the steel bar effectively inhibited the steel from corrosion inside the concrete.

The potential of all wired rebars during the test was below $-0.8\ V_{cse}$ or at least 0.1V lower than the potential of the black steel rebars which was above $-0.7_{cse}$, as shown in FIG. 3, indicating that the steel of the wired rebar was sufficiently cathodically polarized to a potential range at which the steel is thermodynamically more stable through the galvanic action between the steel and the attached zinc wire. FIG. 4 shows also that under the applied test conditions the zinc coating on the galvanized rebar only lasted for about 100 days, after which the potential of the rebar became similar to that of black rebar and the protective effect of the coating on the steel ceased. Compared to the zinc coating on the galvanized rebar, the zinc wire gave much longer protection to the steel bar inside the concrete.

It was visually estimated that for the wired rebars more than half of the wire still remained attached to the steel on the completion of the test, so that considerable protection remained. The zinc coating on the galvanized rebar on the other hand was effectively gone before the end of the test.

The rebar of the present invention provides a number of important advantages. Concrete structures employing the invention do not require membrane layers or other measures to prevent the permeation of road salts. An extended life of rebars and consequently an extended life of the reinforced concrete structure may be anticipated. The continuous attachment of a zinc wire to a rebar can be easily incorporated into a simple and inexpensive manufacturing process.

It will be understood, of course, that modifications can be made in the embodiment of the invention illustrated and described herein without departing from the scope and purview of the invention as defined in the appended claims.

What I claim as new and desire to protect by Letters Patent of the United States is:

1. A method of providing galvanic protection to a steel article having a length, comprising attaching at least one wire or semi-circular strip of a sacrificial metal or metal alloy selected from the group consisting of zinc, aluminum and magnesium and alloys thereof in continuous electrical contact along the length of the steel article by a weld, solder joint or co-extrusion of the wire or semi-circular strip to the steel article.

2. A method as claimed in claim 1 wherein said elongated steel article is a reinforcing steel bar, and attaching a zinc wire in continuous electrical contact to said reinforcing steel bar in continuous electrical contact along the length of the bar.

3. A method as claimed in claim 2, attaching a plurality of equispaced zinc wires to the reinforcing steel bar.

4. A method as claimed in claim 1 wherein said elongated steel article is a reinforcing steel bar, and attaching a straight zinc wire in continuous electrical contact to said reinforcing steel bar in continuous electrical contact along the length of the bar.

5. A method as claimed in claim 2, attaching at least one zinc wire in a helical path to the reinforcing steel bar along the length of the bar.

6. A method as claimed in claim 1, in which said steel article is a beam, bar, strip, pipe, plate or channel.

7. A method as claimed in claim 6, in which a plurality of spaced-apart zinc wires or zinc semi-circular strips are secured to the steel article along the length thereof.

8. A galvanically-protected steel article comprising a steel article having an exterior surface with a length, and at least one wire or semi-circular strip of a sacrificial metal or metal alloy selected from the group consisting of zinc, aluminum and magnesium and alloys thereof attached in continuous electrical contact along the length of the exterior surface of the steel article by a weld, solder joint or co-extrusion of the wire or semi-circular strip to the steel article.

9. A galvanically-protected steel article as claimed in claim 8 wherein said steel article is a beam, bar, rod, strip, pipe, plate or channel.

10. A galvanically-protected steel article as claimed in claim 9 in which at least one zinc wire or semi-circular zinc strip is attached to the steel article along the length thereof.

11. A galvanically-protected steel article as claimed in claim 9 in which a plurality of parallel spaced-apart zinc wires or semi-circular zinc strips are secured to the steel article along the length thereof.

12. A galvanically-protected steel article as claimed in claim 9 consisting of a bar, rod or pipe and pipe and a zinc wire or semi-circular strip attached in electrical contact in a helical path along the length of the article.

13. A reinforcing steel bar for use in reinforced concrete comprising, a steel bar having a length, and a straight zinc wire and securing means adapted to fasten the zinc wire to the steel bar in electrical contact by a weld, solder joint or co-extrusion along the length of the steel bar.

14. A reinforcing bar as claimed in claim 9 in which the securing means is a weld.

15. A reinforcing bar as claimed in claim 9 in which the securing means is a solder joint.

16. A reinforcing bar as claimed in claim 9 in which the steel bar and the zinc wire are co-extruded.

* * * * *